US010648721B2

(12) United States Patent
Temizkan

(10) Patent No.: US 10,648,721 B2
(45) Date of Patent: May 12, 2020

(54) HOUSEHOLD COOLING APPLIANCE COMPRISING AN ICE MAKER UNIT AND A DISPLAY UNIT FOR DISPLAYING THE WEIGHT OF ICE MADE

(71) Applicant: BSH HAUSGERAETE GMBH, Munich (DE)

(72) Inventor: Senol Temizkan, Aalen (DE)

(73) Assignee: BSH Hausgeraete GmbH, Munich (DE)

( * ) Notice: Subject to any disclaimer, the term of this patent is extended or adjusted under 35 U.S.C. 154(b) by 209 days.

(21) Appl. No.: 15/646,320

(22) Filed: Jul. 11, 2017

(65) Prior Publication Data

US 2019/0017737 A1 Jan. 17, 2019

(51) Int. Cl.
*F25C 5/20* (2018.01)
*F25C 5/187* (2018.01)

(52) U.S. Cl.
CPC ..... *F25C 5/187* (2013.01); *F25C 5/22* (2018.01); *F25C 2600/04* (2013.01); *F25C 2700/02* (2013.01); *F25D 2323/021* (2013.01); *F25D 2400/36* (2013.01); *F25D 2400/361* (2013.01)

(58) Field of Classification Search
CPC ... F25C 5/187; F25C 2700/02; F25D 2400/36
See application file for complete search history.

(56) References Cited

U.S. PATENT DOCUMENTS 4,358,932 A * 11/1982 Helfrich, Jr. ..... F25D 17/062 62/126
7,869,201 B2 * 1/2011 McCoy ..... F16M 11/08 248/917
7,870,753 B2 * 1/2011 Marcy ..... F25D 23/028 312/405
8,214,494 B1 * 7/2012 Slavin ..... G08B 25/08 709/224
2005/0268624 A1 * 12/2005 Voglewede ..... F25D 23/126 62/126
2007/0039335 A1 * 2/2007 Kwon ..... F25C 1/04 62/138
2008/0092571 A1 * 4/2008 Allison ..... F25C 5/187 62/157
2008/0156823 A1 * 7/2008 Kim ..... F25C 5/22 221/13
2016/0113422 A1 * 4/2016 Huffar ..... G07F 9/105 705/23

* cited by examiner

*Primary Examiner* — Ljiljana V. Ciric
*Assistant Examiner* — Alexis K Cox
(74) *Attorney, Agent, or Firm* — Laurence A. Greenberg; Werner H. Stemer; Ralph E. Locher

(57) ABSTRACT

A household cooling appliance has an ice maker unit, a container for storing ice produced by the ice maker, a weight detection unit for capturing the weight of the ice in the container, and a display unit with a display field for displaying the weight of the ice made.

12 Claims, 2 Drawing Sheets

HOUSEHOLD COOLING APPLIANCE COMPRISING AN ICE MAKER UNIT AND A DISPLAY UNIT FOR DISPLAYING THE WEIGHT OF ICE MADE

TECHNICAL FIELD

The invention relates to a household cooling appliance comprising an ice maker unit for making ice. The ice maker unit comprises a container, in which the ice can be stored.

BACKGROUND OF THE INVENTION

Household cooling appliances for storing and preserving food, which comprise an ice maker unit, are known. For determining a filling level of ice in a container of the ice maker unit complex methods are known, in which by means of optical detection the filling level is determined. Besides the complexity of such design this is also prone to errors, in particular due to the possible movements or changes in position of the container, which may also occur due to the filling quantity.

In the case of known ice maker units of household cooling appliances the ice is produced, however it is not known to a user how much ice is already in the container. In case a user needs a larger quantity of ice, he/she needs to empty the container several times, however, does not know when he/she has to do so.

Particularly in the case of larger quantities of ice to be made, this leads to the user having to check very frequently how much ice has already been made. On the other hand, it may also lead to it that in the case of delayed emptying the completion of this required and desired quantity is delayed very much.

SUMMARY OF THE INVENTION

It is the task of the present invention to provide a household cooling appliance, in which a user is informed about the quantity of ice made in a simple and precise way.

This task is solved by a household cooling appliance as claimed.

One aspect of the invention relates to a household cooling appliance, which comprises an ice maker unit for making ice. The ice maker unit comprises a container, in which the ice is storable. The household cooling appliance comprises a weight detection unit for determining the weight of the ice in the container. The household cooling appliance comprises a display unit with a display field for displaying the weight of the ice.

Further features of the invention derive from the claims, the figures, and the description of the figures. The features and feature combinations previously named in the description as well as the features and feature combinations named in the following in the description of the figures and/or shown in the figures alone can be used only in the respective indicated combination, but also in other combinations, without leaving the scope of the invention. Thus, also embodiments of the invention are to be considered as comprised and disclosed, which are not explicitly shown and explained in the figures, however derive through separated feature combinations from the explained embodiments and can be generated therefrom. Also embodiments and feature combinations are to be considered as disclosed, which thus do not have all features of an originally formulated independent claim. Moreover, embodiments and feature combinations are to be considered as disclosed, in particular by the embodiments set out in the above, which go beyond the feature combinations set out in the back-references of the claims or deviate therefrom.

BRIEF DESCRIPTION OF THE DRAWINGS

Embodiments of the invention are explained in more detail in the following on the basis of schematic drawings. These show in.

DETAILED DESCRIPTION OF PREFERRED EMBODIMENTS

In the figures identical and functionally identical elements are equipped with the same reference signs.

With indications "top", "bottom", "front", "rear", "horizontal", "vertical", "depth direction", "width direction", "height direction" etc. the positions and orientations given for intended use and intended arrangement of the ice maker bowl or the appliance are indicated.

Figure 1:
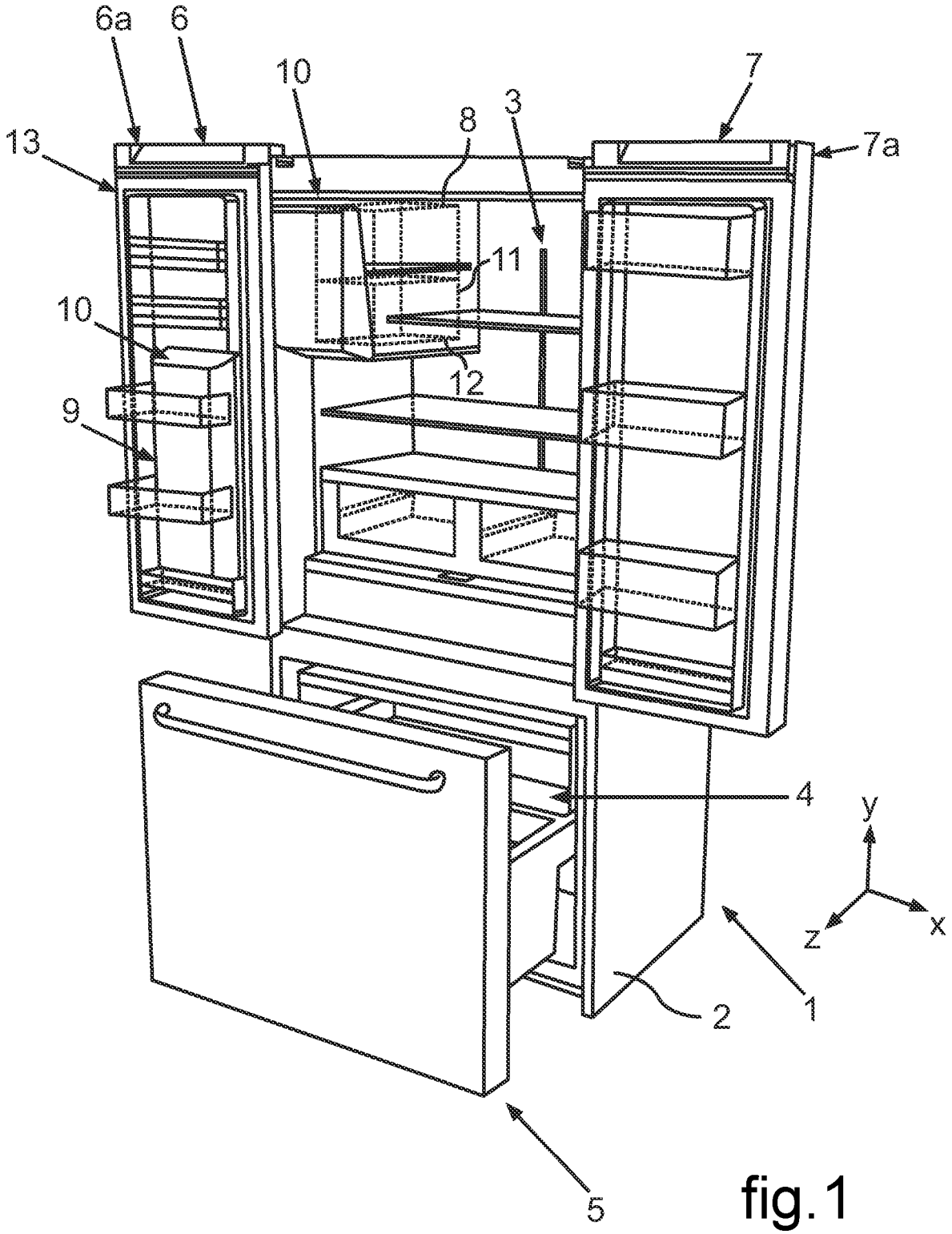
FIG. 1 a perspective view of an embodiment of a household cooling appliance according to the invention.

In FIG. 1 in a perspective view an embodiment of a household cooling appliance 1 is shown. The household cooling appliance 1 is configured for storing and preserving food. In the shown embodiment the household cooling appliance 1 is a fridge/freezer combination appliance. However, it may also be only a cooling appliance.

The shown household cooling appliance 1 has an outer housing 2. In the outer housing 2 a first receiving space for food is formed, which here is a cooling compartment 3. The household cooling appliance 1 moreover comprises a second receiving space for food, which is separate from the first receiving space and here is a freezer compartment 4. As can be seen, in the embodiment shown here the cooling compartment 3 and the freezer compartment 4 are arranged one above the other in the height direction (y direction) of the household cooling appliance 1. The freezer compartment 4, which is arranged further down, can be closed by a door 5. The door 5 in the shown embodiment is a front wall of a drawer, which can be shifted linearly in the depth direction (z direction) of the household cooling appliance 1. The cooling compartment 3 on the front side can be closed by two separate doors 6 and 7, which are shown in FIG. 1 in the open state. The two separate doors 6 and 7 are pivotable via pivot axes that are oriented vertically and are arranged on the outer housing 2. The two doors 6 and 7 are arranged next to each other in the width direction (x direction) and in the closed state extend in a front side plane. In particular also the door 5 in the closed state extends in this plane, in which also the two doors 6 and 7 extend in the closed state.

The household cooling appliance 1 moreover comprises a dispenser unit 10, which is configured for dispensing ice form elements or crushed ice. The dispenser unit 10 moreover can also optionally be configured for dispensing a beverage. The dispenser unit 10 comprises an ice maker unit 8. The ice maker unit 8 in the shown embodiment is arranged internally situated in the cooling compartment 3. This means that whilst the ice maker unit 8 is configured and arranged to be thermally insulated against the cooling compartment 3, however, only accessible and reachable via the feeding aperture of the cooling compartment 3. Thus, the ice maker unit 8 can be made accessible only when at least the door 6 is opened.

The dispenser unit 10 in addition to the ice maker unit 8 also has an output unit 9. The output unit 9 here is for instance configured to be integrated in the door 6. On an external surface of the door 6 facing away from the cooling compartment 3, which then is also a front side, a niche is formed, into which a receiving container can be placed and in which then via the output unit 9 the ice form elements or the crushed ice can be dispensed.

The ice maker 8 moreover comprises a container 11. The container 11 is configured for receiving ice form elements, which are made by the ice maker unit 8. It is arranged in the interior of the housing of the ice maker unit 8 shown in FIG. 1. Ice form elements that are made by freezing liquid in an ice form element vessel of the ice maker unit 8 then upon being taken out fall out of the ice form element vessel into the container 11 and are stored therein.

The ice maker unit 8 moreover comprises a weight detection unit 12, which is shown in FIG. 1 merely symbolically. The representation in FIG. 1 therefore is not to be understood in a restrictive way neither in terms of location, of object, nor position. The weight detection unit 12 can for instance comprise a strain gauge. The weight detection unit 12, however, can for instance also comprise a piezo film. Also a rotation bearing can be part of the weight detection unit 12, wherein here the container 11 then on the one hand is connected with a fixed bearing, on the other hand with at least one movable bearing of this rotation bearing. Depending on rotation movement then initiated by the weight the weight of the container with the ice can be determined, in particular then also be captured and analyzed accordingly. Preferably, the household cooling appliance 1 for this purpose comprises an analyzing unit, which can determine this weight, in particular that of the ice alone.

Moreover, it is in particular envisaged that the household cooling appliance 1 comprises a display unit 13 (FIG. 2), which for instance can be arranged on an external surface 6*a* of the door 6. This display unit 13, however, can also be configured for instance on an external surface 7*a* of the other door 7. If the household cooling appliance 1 with regard to the number and design as well as the positional arrangement of the doors is designed to differ from that in FIG. 1 and can for instance only have one door, the display unit 13 for instance can also be arranged on the external surface of this one door.

In an alternative embodiment the display unit 13 can also be non-destructively releasable from the household cooling appliance and thus also be in particular a portable display unit 13.

The display unit 13 in a further embodiment can comprise an additional function and can for instance be a communication end device. For instance for this purpose it can be a mobile radio device, which for instance is a smartphone. Also a design as tablet can be envisaged.

Figure 2:
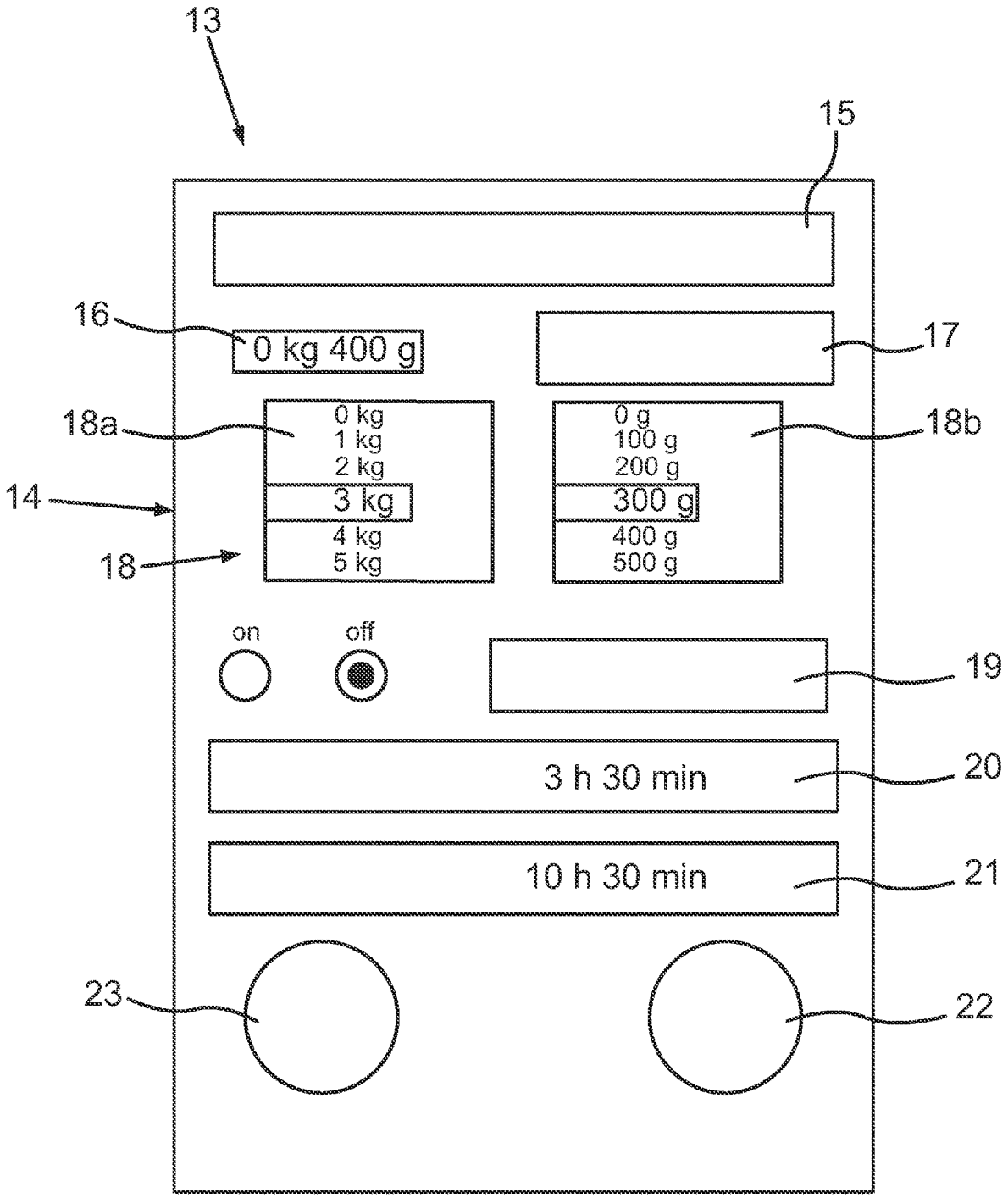
FIG. 2 a representation of an embodiment of a display surface of a display unit of the household cooling appliance.

The display unit 13 in FIG. 2 is shown with an exemplary display surface 14. The display surface 14 in an advantageous embodiment can be configured as touch-sensitive operating interface. In particular the display surface 14 has no manual operating element, which for instance would be a rotary knob or a rocker switch or a rocker key or the like. Those elements on the display surface 14, which are operable and selectable, are in particular configured as touch-sensitive display areas.

In particular it is envisaged that by this display unit 13 the current loading of the container 11 and thus the weight of the ice currently present in the container 11 can be indicated to the user at any time. Thereby the user knows at any time and immediately how much ice has already been made. The display surface 14 in an advantageous embodiment can comprise a display field 15, in which an operating state information is indicated. For instance here in text form or by symbols the measuring of the weight can be indicated. The user is then informed that possibly currently a weight measurement is performed.

In a particularly advantageous way the display surface 14 comprises a display field 16, in which the currently made quantity of ice is shown. In the exemplary representation the user of the display unit 13 is informed that presently 400 g ice have been made. In particular in a further display field 17 adjacent thereto then a text information can be displayed, which for instance can be the term "filling quantity". The user thus with regard to a multiple information display is also informed intuitively on the display surface 14. He thus also knows which weight information has which meaning, even if several display fields with weight information are displayed.

In a further display field, which is a selection field 18, a selection can be made as to what quantity of ice should be made. The selection field 18 thus is also a selection field at the same time. In the shown embodiment moreover it is also envisaged that the selection field 18 is formed from at least two sub-fields 18*a* and a sub-field 18*b* shown next to it. In particular it is envisaged that in the sub-field 18*a* the selection of a weight value can occur in a first weight unit, here kilogram. In a second sub-field 18*b* the selection of a weight value in a weight unit that is different therefrom, here in gram, is possible. The sub-fields 18*a* and 18*b* are preferably touch-sensitive scroll fields so that a multitude of selectable values can be displayed and scrolled. In the shown embodiment it is envisaged that the respective quantity values then selected, here in the sub-field 18*a* 3 kg and in the sub-field 18*b* the quantity 300 g, are optically marked. It may then be envisaged that these concrete values are displayed in larger script and/or in optically different representation than other equally selectable and still recognizable values in the respective sub-fields 18*a* and 18*b*.

In a further advantageous embodiment it is envisaged that on the display surface 14 a further display field is shown. By this display field, which is a selection field 19, also the selection of a specific operating function, namely the operating function "turbo ice" is facilitated. For instance by touching the selection field 19 it can be chosen between the activating and the deactivating of this "turbo ice" function. Thereby in a possibly particularly fast way the making of a specific quantity of ice can be performed.

In a further advantageous embodiment the display surface 14 comprises a further display field 20. In this in an advantageous way the period of time can be indicated, which will still elapse until emptying the container 11. In this regard it is assumed that the container 11 is maximally filled with ice and then emptied. In the example shown here it is still to be waited for three hours and 30 minutes until the container 11 is completely filled with ice and then is to be emptied again in this regard. In addition to the time information also a text information can be displayed to the effect of informing the user that the container 11 should be emptied after this period of time.

In a further advantageous embodiment it is envisaged that the display surface 14 comprises a further display field 21. In this display field 21 in an advantageous way the period of time is indicated, which will still elapse until the quantity of ice as set and desired by user will be completed. For instance this is here 10 hours and 30 minutes. This period of time here, too, is to be taken only symbolically.

On the display surface 14 in further advantageous embodiment a touch-sensitive operating element 22 is configured, with which the making of ice can be started.

In a further advantageous embodiment it may be envisaged that on the display surface 14 a further touch-sensitive operating element 23 is configured. This is connected with the operating function of a "resetting". For instance here incorrect inputs can be corrected or the stopping of an already running ice making operation be conducted. For instance in cases, in which in the follow-up by a user it is recognized by a user that he does not need the originally input quantity of ice to be made, after all, here the process can be stopped or modified.

In particular it may also be envisaged that by the local positioning of the display fields on the display surface 14 a very intuitive operating concept on the one hand and a very intuitive perceptability of the information on the other hand are made possible. In an advantageous way thus also the named display fields are locally arranged in such a way, as they are shown in FIG. 2.

It may also be envisaged that acoustic signals are produced, if for instance the time for emptying the container 11 is reached, but the user does not actually perform the emptying of the container 11 within a temporal tolerance interval. The same can occur for the period of time and the information as to the display field 21. A very efficient ice making process is thereby facilitated, in particular also with regard to the operations of the user. An undesired delay in the ice making process or realizing too late that already a certain quantity of ice is completed and can be used, is thereby avoided.

In the case that the display unit 13 is a portable device, the user invariably is provided with the information, even if he is not standing immediately in front of the household cooling appliance 1, or is outside the space in which the household cooling appliance 1 is situated. Thereby, too, undesired delays can be avoided.

In an advantageous embodiment it is envisaged that the input of a desired quantity of ice of between 100 g and 20 kg is facilitated. In the very case of very large quantities of ice, which are meant to be made, the embodiments set forth above are of particular advantage.

In general, in one aspect of the invention it is envisaged that the display unit comprises a selection field for selecting a quantity of ice to be made. A further aspect envisages that this display field configured as selection field comprises two sub-fields, wherein by a first sub-field a quantity in a superior weight unit is selectable, and by a second sub-field a quantity in a subordinate weight unit is selectable. The selection field can be configured as touch sensitive scroll field.

A further aspect of the invention relates to a display unit of the household cooling appliance with a selection field, by which a turbo function for accelerated making of ice is effected. The display unit can comprise a display field, in which a period of time, when the container is to be emptied, is displayed. The display unit can also comprise a display field, in which a period of time, how long it takes until the desired quantity of ice is made is indicated.

The display unit can be installed fixed on the household cooling appliance. However, it can also be configured as non-destructively releasable display unit and thus be removed from the household cooling appliance and be rearranged thereon. For instance here a mechanical mount may be envisaged. Equally, however, also for instance a magnetic fixture may be envisaged. The display unit can be configured as portable unit. It can also be a communication end device.

The display fields, which can also be envisaged as selection fields, can be designed as touch-sensitive operating fields. The display unit can also comprise a start button and a reset button, which are preferably equally configured as touch-sensitive keys.

LIST OF REFERENCES

1 household cooling appliance
2 outer housing
3 cooling compartment
4 freezer compartment
5 door
6 door
6*a* external surface
7 door
7*a* external surface
8 ice maker unit
9 output unit
10 dispenser unit
11 container
12 weight detection unit
13 display unit
14 display surface
15 display field
16 display field
17 display field
18 selection field
18*a* sub-field
18*b* sub-field
19 selection field
20 display field
21 display field
22 operating element
23 operating element

The invention claimed is:

1. A household cooling appliance assembly, the assembly comprising:

an ice maker unit for making ice, wherein the ice maker unit includes a container configured to store ice produced by the ice maker, a weight detection unit for determining the weight of the ice in the container, a display unit, configured to communicate with said weight detection unit, with a display field for displaying the weight of the ice in the container; and wherein the display unit comprises a display field for displaying a period of time remaining before the container is full.

2. The household cooling appliance assembly according to claim 1, wherein the display unit comprises a selection field for selecting a quantity of ice to be made.

3. The household cooling appliance assembly according to claim 2, wherein the selection field comprises two sub-fields, wherein by a first sub-field a quantity in a superior weight unit is selectable, and by a second sub-field a quantity in a subordinate weight unit is selectable.

4. The household cooling appliance assembly according to claim 2, wherein the selection field is configured as touch-sensitive scroll field.

5. The household cooling appliance assembly according to claim 1, wherein the display unit comprises a selection field, by which a turbo function for accelerated ice making is effected.

6. The household cooling appliance assembly according to claim 1, wherein the display unit is mounted to be fixed on the household cooling appliance.

7. The household cooling appliance assembly according to claim 1, wherein the display unit is configured as portable unit.

8. The household cooling appliance assembly according to claim 1, wherein the display unit is a communication end device.

9. The household cooling appliance assembly according to claim 1, wherein the display unit comprises a start button.

10. The household cooling appliance assembly according to claim 1, wherein the display unit comprises a reset button.

11. The household cooling appliance assembly according to claim 1, wherein the display unit comprises a touch-sensitive display surface, for displaying at least one display field.

12. A household cooling appliance assembly, the assembly comprising:

an ice maker unit for making ice, wherein the ice maker unit includes a container configured to store ice produced by the ice maker, a weight detection unit for determining the weight of the ice in the container, a display unit, configured to communicate with said weight detection unit, with a display field for displaying the weight of the ice in the container; and wherein the display unit comprises a display field for displaying a period of time until the desired quantity of ice has been made.

* * * * *